United States Patent [19]

Shimizu

[11] 4,368,880

[45] Jan. 18, 1983

[54] MACHINE FOR FEEDING SHEETS OF PAPER

[76] Inventor: Masaaki Shimizu, c/o Horizon Co., Ltd., 5-10, Kuze Oyabu-cho, Minami-ku, Kyoto, Japan

[21] Appl. No.: 177,732

[22] Filed: Aug. 13, 1980

[51] Int. Cl.[3] ..... B65H 3/52

[52] U.S. Cl. ..... 271/121; 271/167

[58] Field of Search ..... 271/121, 124, 167, 109

[56] References Cited

U.S. PATENT DOCUMENTS 1,136,171 4/1915 Saunders ..... 271/121

3,847,385 11/1974 Wieloch ..... 271/121

FOREIGN PATENT DOCUMENTS 2263468 7/1974 Fed. Rep. of Germany ..... 271/124

*Primary Examiner*—Richard A. Schacher

*Attorney, Agent, or Firm*—Christensen, O'Connor, Johnson & Kindness

[57] ABSTRACT

A machine for feeding sheets of paper or the like one after another, wherein until a sheet is nipped between a front feed roller and a friction plate, a sufficiently great pressure is maintained between the roller and the plate so as to prevent simultaneous nipping of two or more piled sheets, and once the sheet is nipped between the roller and the friction plate, the pressure therebetween is reduced so as to prevent the sheet from being wrinkled, ruptured or otherwise damaged while effecting smooth feeding of the sheet.

6 Claims, 4 Drawing Figures

MACHINE FOR FEEDING SHEETS OF PAPER

This invention relates to a machine for feeding sheets of paper or the like one after another, in which simultaneous feeding of two sheets of paper piled one upon another is effectively prevented.

For feeding sheets of paper it is well known in the art to use a rotating roller and a friction plate in contact with the roller. The arrangement of this type of feeding machine is such that the forward edge of a sheet of paper to be fed is nipped between the roller and the friction plate and as the roller is rotated, the sheet of paper is drawn in so as to pass between the roller and the friction plate. In order to prevent two piled sheets of paper from being nipped and drawn in at the same time, it is necessary to keep an appropriate pressure between the roller and the plate. With printed sheets of paper, two adjacent sheets sometimes stick together due to the printing ink, or when the sheets of paper have been cut to a size, they often stick together at the cut edges. In such a case it is necessary to separate the sheets from each other by the above-mentioned pressure between the roller and the friction plate.

If the friction plate and the roller are keep in contact with each other at an increased pressure in order to separate the sheets of paper stuck together, it is indeed possible to prevent simultaneous feeding of two sheets of paper, but the sheets of paper are likely to be wrinkled, torn or otherwise damaged. If the pressure is reduced, it will be impossible to prevent simultaneous feeding of two piled sheets of paper.

Accordingly, the primary object of the invention is to provide a paper feeding machine which is capable of preventing simultaneous feeding of two or more piled sheets of paper.

Another object of the invention is to provide a paper feeding machine in which the mechanism for preventing simultaneous feeding of two piled sheets of paper is so compact in size as to be properly enclosed in the housing of the machine.

According to the invention, until the forward edge of the sheet of paper is nipped between the front feed roller and the friction plate, a relatively great pressure is maintained between the two members so as to prevent simultaneous nipping of two piled sheets of paper without fail, and once the forward edge of the sheet has been nipped, the pressure between the roller and the plate is reduced to such a value as to effect smooth feeding of the sheet thereby to prevent occurrence of wrinkles, rupture or other damages in the sheet.

In a preferred embodiment of the invention, the mechanism for pressing the friction plate against the forward roller is disposed at the downstream side of the roller in the direction of feeding the sheets of paper and at the same time at a lower position than the forward roller. In particular, a lever arm which supports the friction plate at the free end thereof is resiliently biased by a spring or the like in such a direction so as to be pressed against the forward roller. The pivot of the lever arm is positioned beyond the forward roller, that is, at the downstream side thereof in the direction in which the sheets of paper are fed, and at the same time at a lower position than the plane of the sheet of paper being fed or transported.

With the pivot of the lever arm at the above-mentioned position, until a sheet of paper is nipped between the forward roller and the friction plate a component of the force caused by rotation of the roller to move the sheet of paper acts in the same direction as the pressing force caused by the bias so that the pressure between the friction plate and the roller is increased. Once the sheet of paper has been nipped between the front roller and the friction plate, however, the sheet interposed between the two members reduces the feeding force provided by the roller so that the component of the feeding force acting in the same direction as that of the pressing force caused by the bias is reduced, so that the pressing force becomes smaller than it was before the sheet of paper is nipped between the roller and the friction plate, thereby to prevent occurrence of wrinkles and/or rupture in the sheet of paper.

The invention will be described in detail with reference to the accompanying drawings, wherein.

Figure 1:
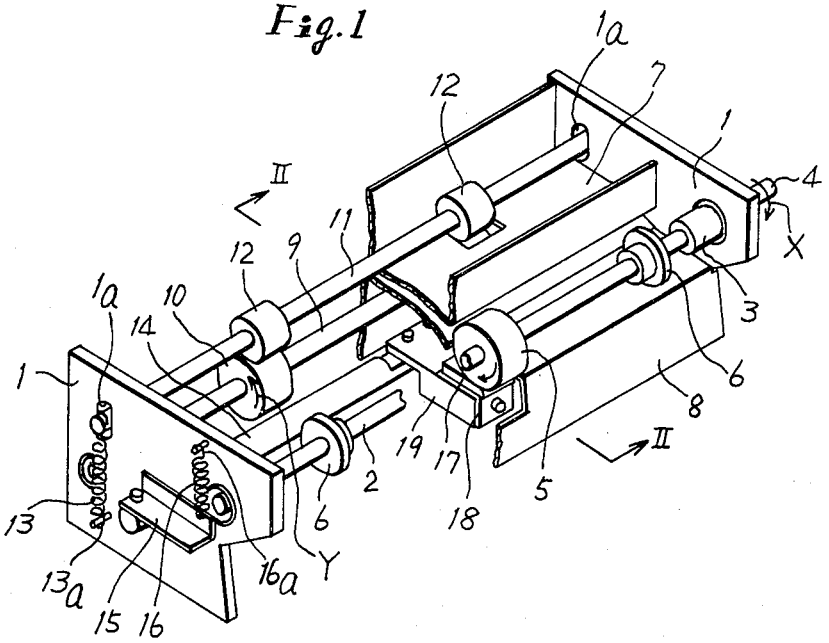
FIG. 1 is a perspective view, partly cut away, of one embodiment of the invention.

Referring to FIG. 1, there are shown a pair of laterial wall plates 1 spaced a predetermined distance apart from each other. A shaft 2 is rotatably supported at opposite ends by the plates 1 and connected through a one-way clutch 3 to a drive shaft 4, which in turn is connected to a suitable drive not shown so that the shaft 4 and consequently the shaft 2 are rotatable in the direction of an arrow X.

While the shaft 2 is disconnected from the drive shaft 4, the former shaft 2 is freely rotatable.

A forward feed roller 5 and a pair of guide rollers 6, all made of, say, rubber are fixed on the shaft 2 for simultaneous rotation with the shaft. An upper guide plate 7 and a lower guide plate 8 are provided with a space therebetween so as to guide the sheet of paper being fed by the rollers 5 and 6. The sheet passes through the space between the guide plates 7 and 8.

A second shaft 9 is rotatably supported by the pair of lateral wall plates 1. A pair of rear delivery rollers 10 are fixed on the shaft 9. A third shaft 11 has its opposite ends loosely passed through slots 1*a* formed in the laterial walls 1 so that the shaft 11 is vertically movable in the slots. A pair of pressure rollers 12 are fixed on the shaft 11 so as to ride on the delivery rollers 10 on the shaft 9.

A spring 13 has its one end fixed to the lateral plate 1 as at 13*a* and its opposite end fixed to one end of the shaft 11 to bias the shaft downwardly, so that the rollers 12 are pressed on the rollers 10, with a similar spring not shown being provided at the opposite end of the shaft 11. Thus, if the shaft 9 is rotated or the rollers 10 are rotated in a direction Y by a belt not shown but in driving contact with the roller 10, the rollers 12 are also rotated.

Figure 2:
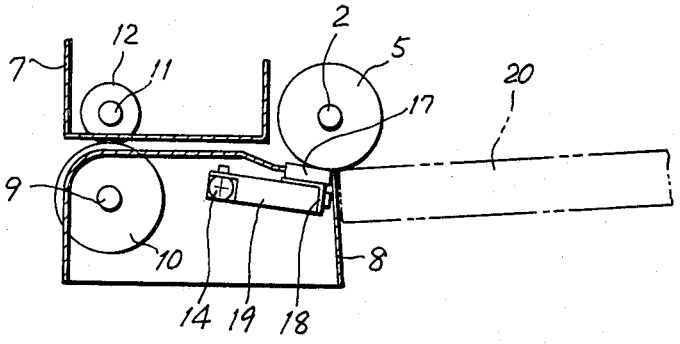
FIG. 2 is a vertical section taken along II—II of FIG. 1.

A support rod 14 is supported by the pair of lateral plate 1 rotatably at least through a predetermined angle. A lever 15 has its one end fixed to one end of the rod 14. A spring 16 has its one end connected to the opposite end of the lever 15 and its opposite end fixed to the lateral wall as at 16*a*, so that the force of the spring 16 biases the lever 15 upwardly or counterclockwise in FIG. 2.

A friction plate 17 made of, say, rubber is disposed below the forward roller 5. The plate 17 is fixed at its underside to a mounting member 18, which in its turn is detachably mounted on the free end of an arm 19 the opposite end of which is fixed to the rod 14.

When the friction plate 17 has been worn out, the plate 17 together with the mounting member 18 can be detached from the arm 19 for replacement.

The plate 17 is pressed against the forward roller 5 from below by the rotational force of the rod 14 caused by the spring 16.

Sheets of paper piled one upon another and collectively shown at 20 for simplicity of illustration are placed in front of the forward roller 5. The sheets 20 as a whole are movable upwardly so that as the feeding proceeds the uppermost one sheet has its forward edge positioned adjacent to the contact line between the roller 5 and the plate 17.

In accordance with the invention, the axis of rotation of the rod 14 is positioned at the downstream side of the roller 5 in the feeding direction in which the sheet of paper is moved and at the same time below the sheet being moved.

When the shaft 2 and consequently the roller 5 are rotated by rotating the drive shaft 4 in the direction of the arrow X, the uppermost one sheet of paper in the pile 20 is nipped between the roller 5 and the friction plate 17 so as to be carried forward. About the time the forward edge of the sheet of paper is nipped between the pressure rollers 12 and the delivery rollers 10, the rotation of the drive shaft 4 is stopped. Since the delivery rollers 10 are always rotating, the sheet of paper is carried further ahead between the rollers 10 and 12, with the roller 5 freely rotating despite the stoppage of the drive shaft 4 so that no pulling force is exerted on the sheet, which will be carried on.

About the time the rear edge of the sheet of paper has passed the contacting point between the forward roller 5 and the friction plate 17, rotation of the drive shaft 4 is resumed, whereupon feeding of the next sheet of paper is started. The cycle of operation is repeated for successive feeding of sheets of paper.

As previously mentioned, an increase in the pressure of the friction plate 17 against the roller 5 results in occurrence of wrinkles and/or rupture of the sheet of paper being fed. In accordance with the invention, despite a sufficiently large pressure between the roller and the plate, once a sheet of paper has been nipped between the roller 5 and the plate 17, the pressure therebetween is reduced.

Figure 3:
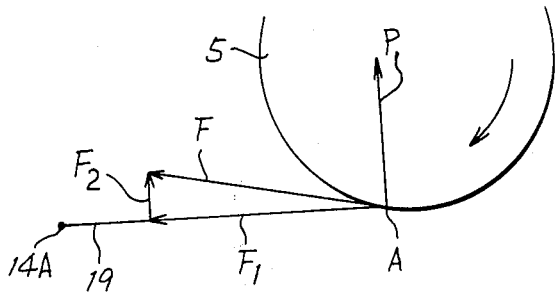
FIG. 3 is a view for explaining the principle of operation of the device of the invention.

Referring to the vector diagram of FIG. 3, let 14A designate the axis of rotation of the rod 14 and the letter A designate the point at which the forward roller 5 and the friction plate 17 contact.

When the rod 14 is rotated counterclockwise through an angle about the axis 14A, the friction plate 17 is pressed against the roller 5, with a force P acting on the roller 5. As the roller 5 is rotated, a force F acts to move the sheet of paper in the direction of feeding the sheet. The force F comprises a component F1 in the longitudinal direction of the arm 19 and a component F2 in a direction perpendicular thereto. The force F2 acts upwardly in the same direction as the force P, so that the counterforce corresponding to the sum of the forces P and F2 is the pressing force exerted by the roller 5 on the friction plate 17. This pressing force counteracts feeding of the sheet of paper so that simultaneous nipping of more than two sheets between the roller 5 and the plate 17 is prevented. The greater is the pressing force, the more effective it is to prevent simultaneous nipping of two sheets of paper.

Once a sheet of paper has been nipped between the roller 5 and the friction plate 17, however, the roller 5 that has until then been in contact with the friction plate 17 is separated from the latter a distance corresponding to the thickness of the nipped sheet of paper so that the roller 5 no longer directly contacts the friction plate 17. This results in a sudden decrease of the force F and consequently its components F1 and F2. The decrease of the component F2 in turn reduces the pressing force of the roller 5 against the sheet of paper (which force has been acting directly on the plate 17 until then) thereby to effectively prevent the sheet from being wrinkled, ruptured or otherwise damaged.

By setting the pressing force of the roller 5 against the friction plate 17 to as sufficient a magnitude as is required until a sheet of paper is nipped between the roller and the plate, it is possible to prevent two sheets of paper from being simultaneously nipped between the roller 5 and the plate 17.

Figure 4:
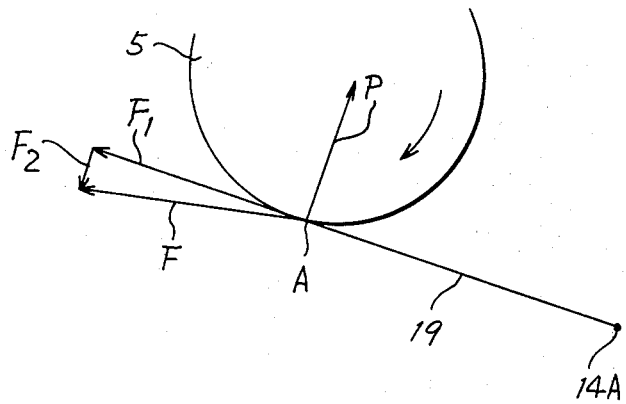
FIG. 4 is a view similar to FIG. 3 but showing the principle of operation of a different arrangement from the invention.

For comparison the arrangement that the rod 14 is positioned in front of or at the upstream side of the roller 5 in the feeding direction will now be discussed with reference to the vector diagram of FIG. 4.

As shown, the force F consists of a component F1 in the longitudinal direction of the lever 19 and a component F2 in a direction perpendicular thereto. The component F2 is directed downwardly, that is, in a direction opposite to that of the force P, so that the actual pressing force between the roller 5 and the friction plate 17 becomes smaller than the force P. Therefore, in order to prevent simultaneous nipping of two sheets of paper between the roller and the plate, the force of rotation of the rod 14, that is, the force of the spring 16 must be increased. When a sheet of paper is nipped between the roller 5 and the plate 17, the force F decreases, but the great force of the spring 16 causes the sheet of paper to be strongly pressed between the roller 5 and the plate 14 with resulting production of wrinkles in the sheet and/or rupturing of the sheet.

With the sheet being nipped with a strong force in the above-mentioned manner, if the sheet is moved by the rollers 10 and 12 nipping the forward edge of the sheet, a strong pulling force acts on the sheet so that the sheet is likely to be ruptured. This can be avoided by the arrangement of this invention.

As described above, in accordance with the invention, until a sheet of paper is nipped between the forward roller and the friction plate, the pressing force therebetween is kept large enough to separate two sheets of paper thereby to prevent simultaneous nipping of two sheets of paper between the roller and the friction plate, and when the sheet of paper has been nipped therebetween, the pressing force is reduced thereby to prevent the sheet from being wrinkled, ruptured or otherwise damaged, while ensuring effective feeding of sheets of paper.

What I claim is:

1. A paper feeding machine for feeding sheets one by one from a stack comprising a roller located adjacent said stack and rotatable in a predetermined direction to feed sheets from said stack, a friction plate so arranged as to cooperate with said roller to nip therebetween the edge of a sheet to be fed, a member pivotable about an axis and so arranged as to cause said friction plate to be pressed against said roller, said axis being positioned below said roller and at the downstream side of said roller in the direction of feeding said sheet, and biasing means associated with said pivotable member to bias said friction plate toward said roller, said biasing means and said pivotable member being constructed and arranged so that said biasing force is constant and unrelated to the number of sheets in said stack.

2. The machine of claim 1 wherein said roller is rotated through a one-way clutch by a drive.

3. The machine of claim 1, wherein said biasing means is a spring.

4. The machine of claim 1, further including at the downstream side of said roller delivery rollers rotatable in a predetermined direction and pressure rollers in contact with said delivery rollers so that said rollers cooperate to deliver the sheet of paper being nipped between said roller and said friction plate.

5. The machine of claim 1, wherein said friction plate is mounted on the free end of an arm, the other end of which is fixed to a rod which is biased by a spring so as to be rotated in such a direction as to pivot said arm thereby to cause said friction plate to be pressed against said roller, the axis of rotation of said rod being positioned below said roller and at the downstream side of said roller in the direction of feeding said sheet.

6. A paper-feeding machine for feeding sheets one-by-one from a stack comprising:

a roller located adjacent said stack and rotatable in a predetermined direction for feeding sheets from said stack;

a friction plate so arranged as to cooperate with said roller to nip therebetween the edge of a sheet to be fed;

a member pivotable about an axis and so arranged as to cause said friction plate to be pressed against said roller, said axis being positioned below said roller and at the downstream side of said roller in the direction of feeding said sheet;

biasing means associated with said pivotable member to bias said friction plate toward said roller, said biasing means and said pivotable member being constructed and arranged so that said biasing force is constant and unrelated to the number of sheets in said stack; and stack-holding means adjacent said roller for holding the stack of sheets so that the sheets are in a substantially horizontal orientation, said stack-holding means constructed and arranged such that the forward edges of said sheets in said stack are arranged substantially vertically.

* * * * *